US005758240A

United States Patent [19]

Ito et al.

[11] Patent Number: 5,758,240

[45] Date of Patent: May 26, 1998

[54] DEVELOPING APPARATUS AND IMAGE FORMING APPARATUS

[75] Inventors: Noboru Ito, Kawanishi; Tamotsu Shimizu, Settsu, both of Japan

[73] Assignee: Minolta Co., Ltd, Osaka, Japan

[21] Appl. No.: 730,359

[22] Filed: Oct. 15, 1996

[30] Foreign Application Priority Data

Oct. 20, 1995 [JP] Japan ..... 7-297608

[51] Int. Cl.[6] ..... G03G 15/09

[52] U.S. Cl. ..... 399/267; 399/265

[58] Field of Search ..... 399/265, 267, 399/272, 273, 274, 275, 277, 119

[56] References Cited

U.S. PATENT DOCUMENTS

| | | | |
|---|---|---|---|
| 4,162,842 | 7/1979 | Wu | 399/256 |
| 4,733,267 | 3/1988 | Enoki et al. | 399/27 |
| 4,777,512 | 10/1988 | Takahashi et al. | 399/30 |
| 4,914,481 | 4/1990 | Yoshikai et al. | 399/230 |
| 4,940,014 | 7/1990 | Saijo et al. | 399/256 |
| 5,075,729 | 12/1991 | Hayashi et al. | 399/150 |
| 5,143,017 | 9/1992 | Haneda et al. | 399/256 |
| 5,503,106 | 4/1996 | Kaneko | 399/56 |

FOREIGN PATENT DOCUMENTS 6-51634 2/1994 Japan .

*Primary Examiner*—Matthew S. Smith

*Attorney, Agent, or Firm*—Burns, Doane, Swecker & Mathis, LLP

[57] ABSTRACT

A developing apparatus according to the present invention comprises a rotating developing sleeve, a developer supplying portion for supplying developer to the surface of the developing sleeve, a developer collecting portion for collecting the developer from the surface of the developing sleeve, the developer collecting portion and the developer supplying portion being vertically aligned, a pair of magnetic poles fixed in the developing sleeve, the pair of magnetic poles forming a triangle area which is surrounded by tangent lines at points where the magnetic poles have the maximum magnetic force, and a wall positioned between the developer supplying portion and the developer collecting portion, the edge of the wall being positioned in the triangle area formed by the pair of magnetic poles.

17 Claims, 10 Drawing Sheets

DEVELOPING APPARATUS AND IMAGE FORMING APPARATUS

BACKGROUND OF THE INVENTION

1. Field of the Invention

The present invention relates generally to a developing apparatus used for developing a latent image formed on an image carrier and an image forming apparatus using the developing apparatus, and more particularly, to a developing apparatus for supplying developer from a developer supplying portion to the surface of a rotating developing sleeve, developing a latent image formed on an image carrier, and then collecting in a developer collecting portion the developer on the surface of the developing sleeve, the developer supplying portion and the developer collecting portion being vertically aligned with a wall interposed therebetween, and an image forming apparatus using the developing apparatus.

2. Description of the Prior Art

In an image forming apparatus such as a copying machine or a printer, various types of developing apparatuses for supplying toner to a latent image formed on an image carrier to develop the latent image have been conventionally employed.

One of the developing apparatuses is a developing apparatus disclosed in Japanese Patent Laying-Open No. 51634/1994, for example. In the developing apparatus, a magnet member 12 having a plurality of fixed magnetic poles N, S, . . . arranged along its periphery is provided along the inner periphery of a developing sleeve 11 in a cylindrical shape which is rotated to introduce developer to an image carrier 1, a developer supplying portion 13*a* and a developer collecting portion 13*b* are vertically aligned with a wall 14 interposed therebetween in an apparatus body 10 so as to be opposite to the developing sleeve 11 in its axial direction, and the developer supplying portion 13*a* and the developer collecting portion 13*b* are respectively provided with feeding members 15*a* and 15*b* composed of screws.

In the developing apparatus, the developer is supplied to the rotating developing sleeve 11 from the developer supplying portion 13*a* positioned above the wall 14 while conveying the developer in the developer supplying portion 13*a* and the developer collecting portion 13*b* upon rotation of the feeding member 15*a* provided in the developer feeding portion 13*a* and the feeding member 15*b* provided in the developer collecting portion 13*b*. The developer is conveyed toward the image carrier 1 by the developing sleeve 11 while being bound on the developing sleeve 11 by a magnetic force produced by the fixed magnetic poles N, S, . . . provided along the inner periphery of the developing sleeve 11, and the quantity of the developer to be conveyed is regulated by a regulating member 16, after which the developer is introduced to a developing area opposite to the image carrier 1 to perform development.

Furthermore, after the development is thus performed, the developer after the development is returned to the apparatus body 10 by the rotating developing sleeve 11. The developer thus returned is collected in the developer collecting portion 13*b* positioned below the wall 14. The collected developer is conveyed in the developer collecting portion 13*b* by the feeding member 15*b*, and is circulated between the developer supplying portion 13*a* and the developer collecting portion 13*b*.

In collecting in the developer collecting portion 13*b* the developer returned to the apparatus body 10 after the development as described above, the fixed magnetic poles N having the same polarity are generally so provided as to be adjacent to each other along the inner periphery of the developing sleeve 11 in such a manner that the wall 14 is interposed therebetween, and the developer is separated from the developing sleeve 11 by a repulsive magnetic field generated between the fixed magnetic poles N having the same polarity.

Even in a case where the fixed magnetic poles N having the same polarity are so provided as to be adjacent to each other along the inner periphery of the developing sleeve 11 in such a manner that the wall 14 is interposed therebetween, however, the developer returned to the apparatus body 10 after the development may not, in some cases, be sufficiently separated from the developing sleeve 11.

As a result of using the developer which is not thus separated for development again, the density of a formed image is decreased, and is made non-uniform. Further, as a result of using the developer for development many times, a formed image is fogged, for example, upon gradual degradation of the developer. Therefore, good image formation cannot be stably performed.

SUMMARY OF THE INVENTION

A first object of the present invention is to so construct the above-mentioned developing apparatus that developer returned to an apparatus body after development is simply and reliably separated from a developing sleeve, and is collected in a developer collecting portion, and new developer is supplied to the developing sleeve from a developer supplying portion.

Another object of the present invention is to make it possible for new developer to be introduced into an image carrier by a developing sleeve and used for development, to stably perform good image formation by eliminating the possibilities that a formed image is decreased in density, is made non-uniform in density, and is fogged, for example.

A first developing apparatus according to the present invention comprises a rotating developing sleeve, a developer supplying portion for supplying developer to the surface of the developing sleeve, a developer collecting portion for collecting the developer from the surface of the developing sleeve, the developer supplying portion and the developer collecting portion being vertically aligned, a pair of magnetic poles fixed in the developing sleeve, the pair of magnetic poles forming a triangle area which is surrounded by tangent lines at points where the magnetic poles have the maximum magnetic force, and a wall positioned between the developer supplying portion and the developer collecting portion, the edge of the wall being positioned in the triangle area formed by the pair of magnetic poles.

As in the first developing apparatus according to the present invention, when the edge of the wall positioned between the developer supplying portion and the developer collecting portion is positioned in the triangle area formed by the pair of magnetic poles, the developer returned to an apparatus body is sufficiently separated from the surface of the developing sleeve, whereby the developer returned after the development is prevented from being used as it is again for development upon passing through the wall. Particularly, if the magnetic poles are made to have the same polarity, a repulsive magnetic field generated between the magnetic poles is satisfactorily exerted at the edge of the wall. Consequently, the developer returned to the apparatus body is more reliably separated from the surface of the developing sleeve, whereby the developer returned after the development is prevented from being used as it is again for development upon passing through the wall. Therefore, new developer is stably supplied to the surface of the developing sleeve from the developer supplying portion.

In an image forming apparatus so adapted as to develop an electrostatic latent image formed on an image carrier using the first developing apparatus, developer is newly supplied to the surface of the developing sleeve stably from the developer supplying portion, and the newly supplied developer is introduced into the image carrier and used for development. As a result, a formed image is not decreased in density, is not made non-uniform in density, and is not fogged, for example, whereby good image formation can be stably performed.

A second developing apparatus according to the present invention comprises a rotating developing sleeve having a plurality of fixed magnetic poles provided along its inner periphery, a developer supplying portion for supplying developer to the surface of the developing sleeve, a developer collecting portion for collecting the developer from the surface of the developing sleeve, the developer supplying portion and the developer collecting portion being vertically aligned, and a wall positioned between the developer supplying portion and the developer collecting portion, the edge of the wall having a magnetic force.

As in the second developing apparatus according to the present invention, when the edge of the wall positioned between the developer supplying portion and the developer collecting portion has a magnetic force, the developer returned to an apparatus body by the function of the magnetic force is sufficiently separated from the surface of the developing sleeve, whereby the developer returned after the development is prevented from being used as it is again for development upon passing through the wall. Particularly, if a magnetic pole at the edge of the wall and a fixed magnetic pole along the inner periphery of the developing sleeve in a position closest to the edge of the wall are made to have the same polarity, the developer returned to the apparatus body is more reliably separated from the surface of the developing sleeve by a repulsive magnetic field generated between the magnetic pole at the edge of the wall and the fixed magnetic pole, whereby the developer returned after the development is prevented from being used as it is again for development upon passing through the wall. Therefore, new developer is stably supplied to the surface of the developing sleeve from the developer supplying portion.

Also in an image forming apparatus so adapted as to develop an electrostatic latent image formed on an image carrier using the second developing apparatus, developer is newly supplied to the surface of the developing sleeve stably from the developer supplying portion, and the newly supplied developer is introduced into the image carrier and used for development. As a result, a formed image is not decreased in density, is not made non-uniform in density, and is not fogged, for example, whereby good image formation can be stably performed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Preferred embodiments of the present invention will be specifically described on the basis of attached drawings.

(Embodiment 1)

Figure 1:
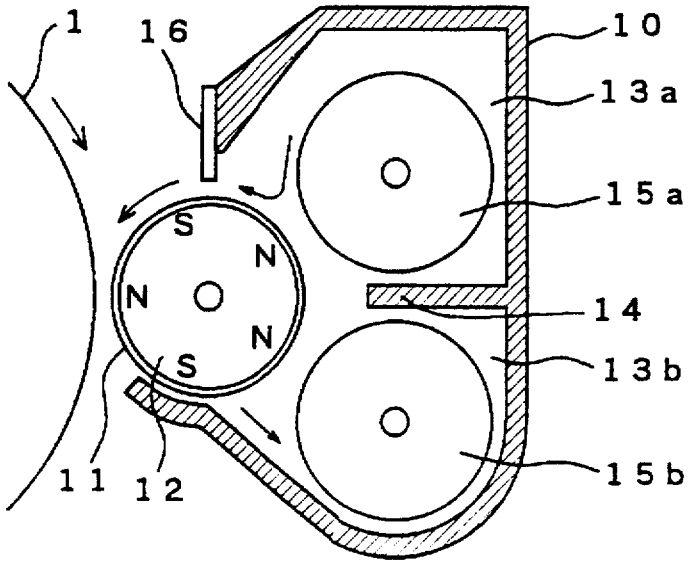
Fig 1 PRIOR ART
FIG. 1 is a schematic illustration of a conventional developing apparatus having a developer supplying portion and a developer collecting portion vertically aligned with a wall interposed therebetween so as to be opposite to a developing sleeve.
Figure 2:
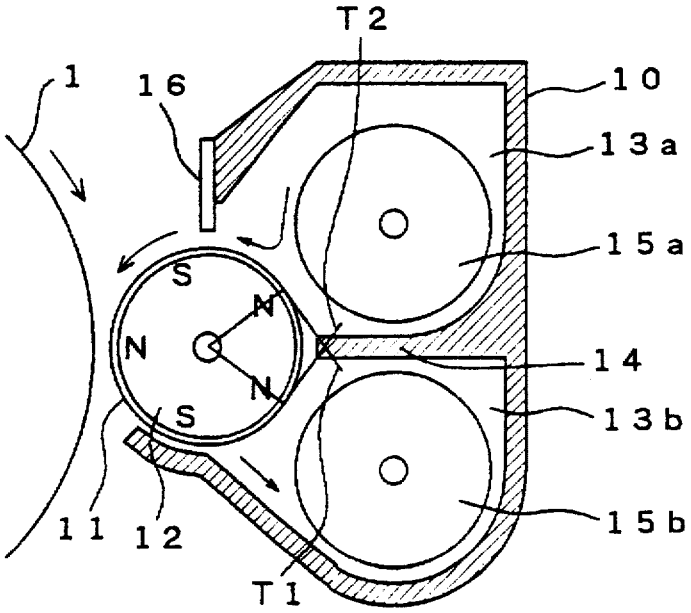
FIG. 2 is a schematic illustration showing a developing apparatus according to an embodiment 1 of the present invention.

Also in a developing apparatus according to an embodiment 1, a magnet member 12 having a plurality of fixed magnetic poles N, S, . . . arranged along its periphery is provided along the inner periphery of a developing sleeve 11 in a cylindrical shape provided opposite to an image carrier 1 as shown in FIG. 2, as in the developing apparatus shown in FIG. 1.

Furthermore, a wall 14 is provided in an apparatus body 10 so as to be opposite to the developing sleeve 11 in its axial direction, and a developer supplying portion 13*a* and a developer collecting portion 13*b* are vertically aligned with the wall 14 interposed therebetween.

The developer supplying portion 13*a* is provided with a feeding member 15*a* composed of a screw for feeding developer while supplying the developer to the surface of the developing sleeve 11, and the developer collecting portion 13*b* is provided with a feeding member 15*b* composed of a screw for feeding developer collected from the surface of the developing sleeve 11.

In the developing apparatus according to the present embodiment, fixed magnetic poles N having the same polarity are so provided as to be adjacent to each other on the upstream and downstream sides in the direction of rotation of the developing sleeve 11 in such a manner that the wall 14 is interposed therebetween along the inner periphery of the developing sleeve 11 in a position opposite to the edge of the wall 14. Further, the edge of the wall 14 is positioned in an area formed by tangent lines T1 and T2 to the developing sleeve at points where the fixed magnetic poles N have the maximum vertical magnetic force and the peripheral surface of the developing sleeve 11.

Figure 3:
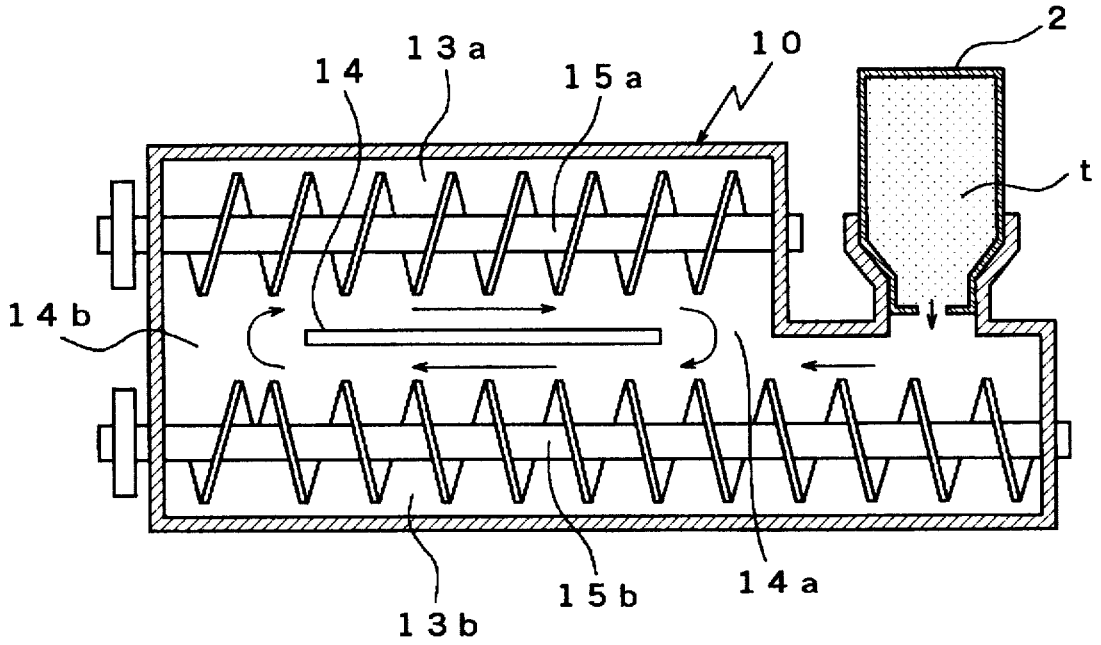
FIG. 3 is a schematic illustration showing a state where developer is circulated in the developing apparatus according to the embodiment 1.

In the developing apparatus according to the present embodiment, the feeding member 15*a* provided in the developer supplying portion 13*a* positioned above the wall 14 is rotated, and the developer is conveyed in the developer supplying portion 13*a* in its axial direction by the feeding member 15*a*, to feed the developer into the developer collecting portion 13*b* positioned below the wall 14 from a circulation port 14*a* provided on the side of one end of the wall 14 as well as supply a part of the developer to the surface of the rotating developing sleeve 11, as shown in FIG. 3.

Furthermore, the developer thus supplied to the surface of the developing sleeve 11 is conveyed toward the image carrier 1 by the rotating developing sleeve 11 while being bound on the developing sleeve 11 by a magnetic force produced by the fixed magnetic poles N, S . . . and the quantity of the developer to be conveyed is regulated by a regulating member 16 so that the developer in predetermined quantity is introduced into the image carrier 1. Consequently, a latent image formed on the image carrier 1 is developed.

After the latent image is thus developed, the developer on the developing sleeve 10 is returned to the apparatus body 11 as the developing sleeve 11 is rotated.

When the developer thus returned to the apparatus body 10 by the developing sleeve 11 is introduced near the wall 14, a repulsive magnetic field generated between the fixed magnetic poles N having the same polarity provided in such a manner that the wall 14 is interposed therebetween is exerted on the developer on the developing sleeve 11. Further, the edge of the wall 14 is positioned in the area formed by the tangent lines T1 and T2 to the developing sleeve 11 at the points where the fixed magnetic poles N have the maximum vertical magnetic force and the peripheral surface of the developing sleeve 11. Therefore, the developer on the developing sleeve 11 is reliably separated from the surface of the developing sleeve 11 before passing through the edge of the wall 14, and is collected in the developer collecting portion 13*b* positioned below the wall 14.

The developer thus collected in the developer collecting portion 13*b*, together with the developer fed from the developing supplying portion 13*a* positioned above the wall 14 as described above, is conveyed in the opposite direction to the developer in the developer supplying portion 13*a*, and is fed into the developer supplying portion 13*a* from a circulation port 14*b* provided on the side of the other end of the wall 14, as shown in FIG. 3, by the rotation of the feeding member 15*b* provided in the developer collecting portion 13*b*, and is circulated between the developer supplying portion 13*a* and the developer collecting portion 13*b*. Further, toner in the developer is consumed. When the density of the toner in the developer is decreased, new toner t is fed into the developer collecting portion 13*b* from a toner container 2 set in a projected part of the developer collecting portion 13*b*.

When the developer returned to the apparatus body 10 after the development as described above is reliably separated from the surface of the developing sleeve 11 before passing through the wall 14 and is collected in the developer collecting portion 13*b*, new developer is supplied to the surface of the developing sleeve 11 from the developer supplying portion 13*a*, and the new developer is always conveyed to the image carrier 1 by the developing sleeve 11 and used for development.

Therefore, when development is performed using the developing apparatus, a formed image is prevented from being decreased in density, being made non-uniform in density, and being fogged, for example, upon degradation of the developer.

Figure 4:
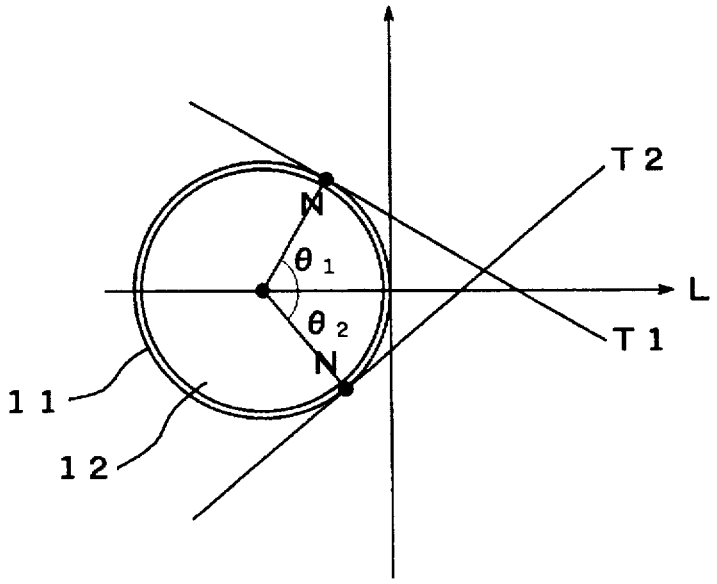
FIG. 4 is a schematic illustration showing the state of an area formed by tangent lines at points where fixed magnetic poles N so provided as to be adjacent to each other along the inner periphery of a developing sleeve have the maximum magnetic force and the peripheral surface of the developing sleeve in the developing apparatus according to the embodiment 1.

In providing the fixed magnetic poles N having the same polarity so as to be adjacent to each other on the upstream and downstream sides in the direction of rotation of the developing sleeve 11 in such a manner that the wall 14 is interposed therebetween along the inner periphery of the developing sleeve 11 in a position opposite to the wall 14 as described above, the positions of the fixed magnetic poles N are suitably changed, to change angles $\theta_1$ and θ2 between the fixed magnetic poles N and the center line L of the developing sleeve 11 as well as change the position of the edge of the wall 14, as shown in FIG. 4.

Development is performed respectively in a case where the edge of the wall 14 is positioned in the area formed by the tangent lines T1 and T2 to the developing sleeve 11 at the points where the fixed magnetic poles N have the maximum vertical magnetic force and the peripheral surface of the developing sleeve 11 as described above and a case where it is positioned outside the area, to compare formed images.

In making the above-mentioned comparison, a developing sleeve 11 having a diameter of 18 mm and a developing sleeve 11 having a diameter of 37 mm are respectively used. Black images of A3 size are respectively formed under conditions: a system speed of 10 cm/s, a quantity of developer to be conveyed of 12 mg/cm$^2$, and a developing gap of 0.4 mm in a developing apparatus using the developing sleeve 11 having a diameter of 18 mm and under conditions: a system speed of 40 cm/s, a quantity of developer to be conveyed of 6 mg/cm$^2$, and a developing gap of 0.3 mm in a developing apparatus using the developing sleeve 11 having a diameter of 37 mm. The difference in image density between the leading end and the trailing end in the formed image is examined. A case where the difference in density is 0 to 0.2 and the image is good is indicated by ○, and a case where the difference in density is not less than 0.2 is indicated by x.

Figure 5:
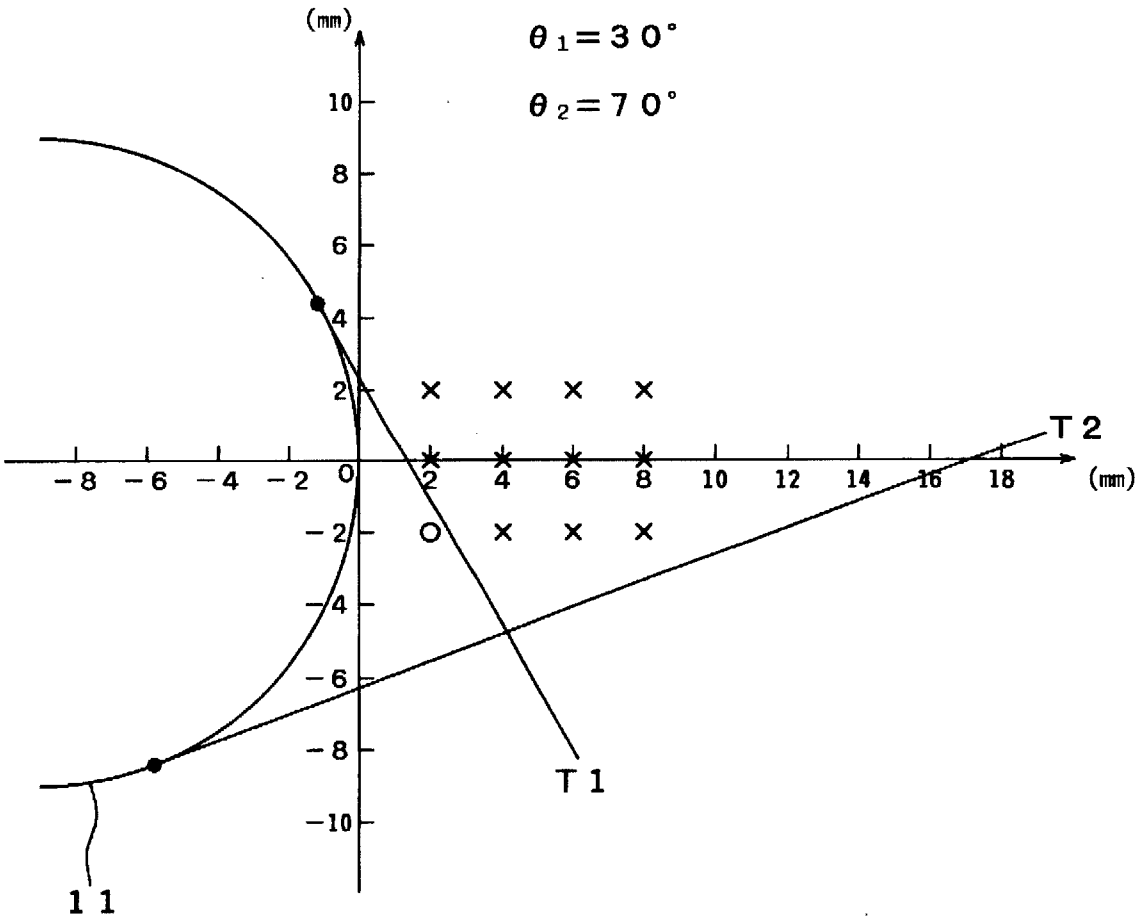
FIG. 5 is a diagram showing results obtained in performing development by using a developing sleeve having a diameter of 18 mm, respectively setting angles $\theta_1$ and $\theta_2$ between fixed magnetic poles N and the center line of the developing sleeve to 30° and 70°, and changing the position of the edge of a wall in the developing apparatus according to the embodiment 1.
Figure 6:
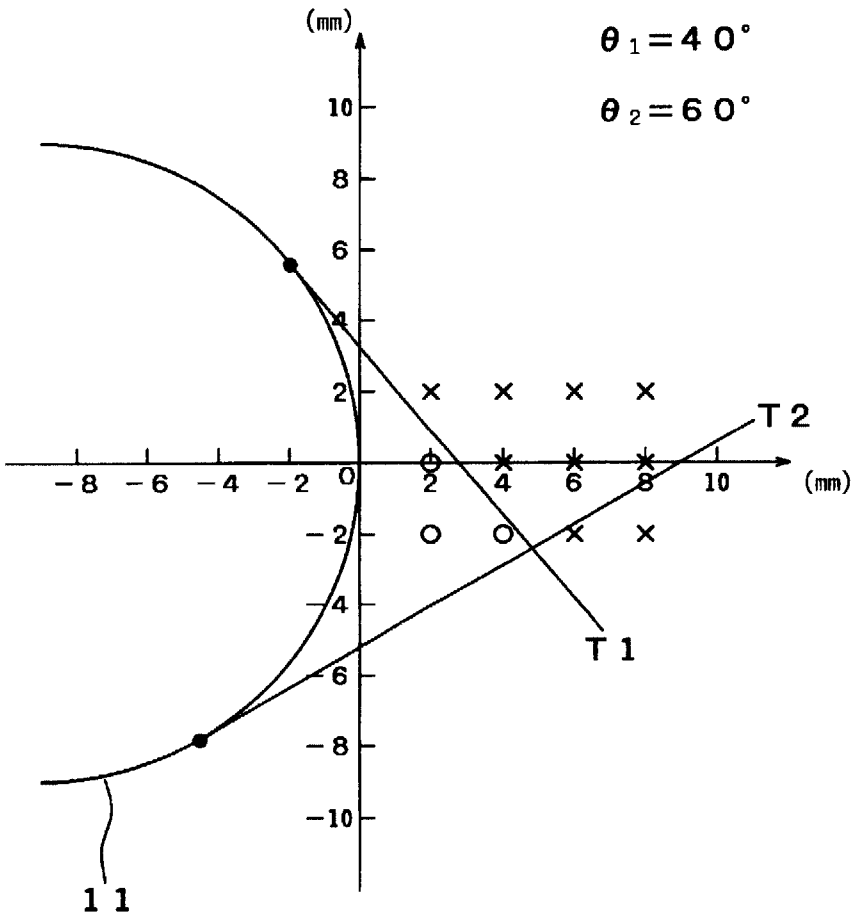
FIG. 6 is a diagram showing results obtained in performing development by using a developing sleeve having a diameter of 18 mm, respectively setting angles $\theta_1$ and $\theta_2$ between fixed magnetic poles N and the center line of the developing sleeve to 40° and 60°, and changing the position of the edge of a wall in the developing apparatus according to the embodiment 1.
Figure 7:
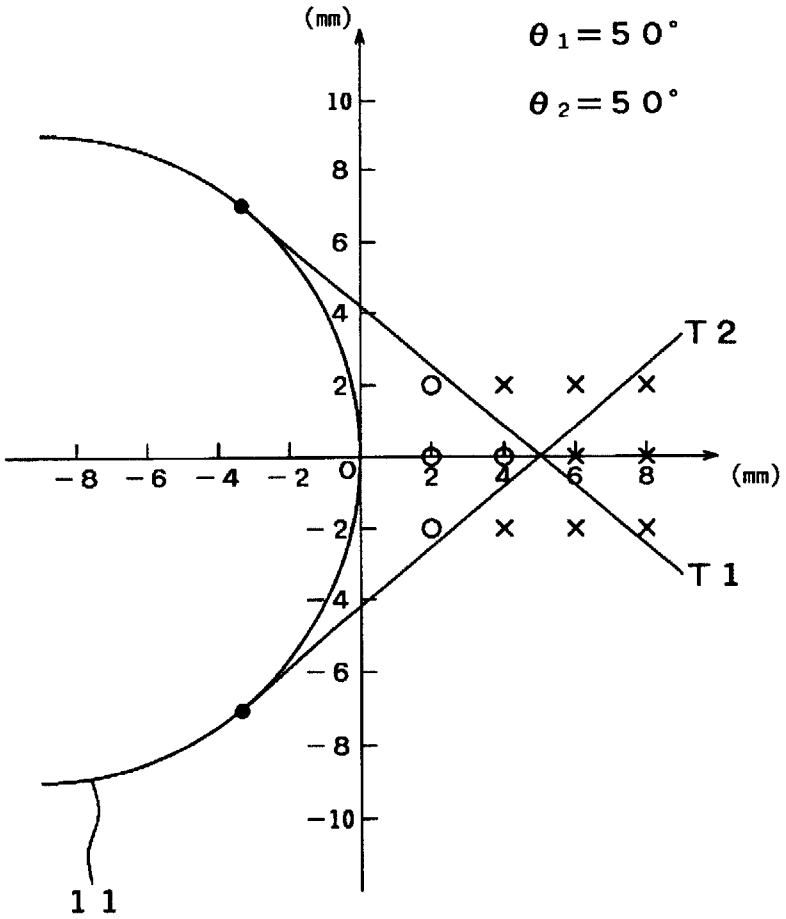
FIG. 7 is a diagram showing results obtained in performing development by using a developing sleeve having a diameter of 18 mm, respectively setting angles $\theta_1$ and $\theta_2$ between fixed magnetic poles N and the center line of the developing sleeve to 50° and 50°, and changing the position of the edge of a wall in the developing apparatus according to the embodiment 1.
Figure 8:
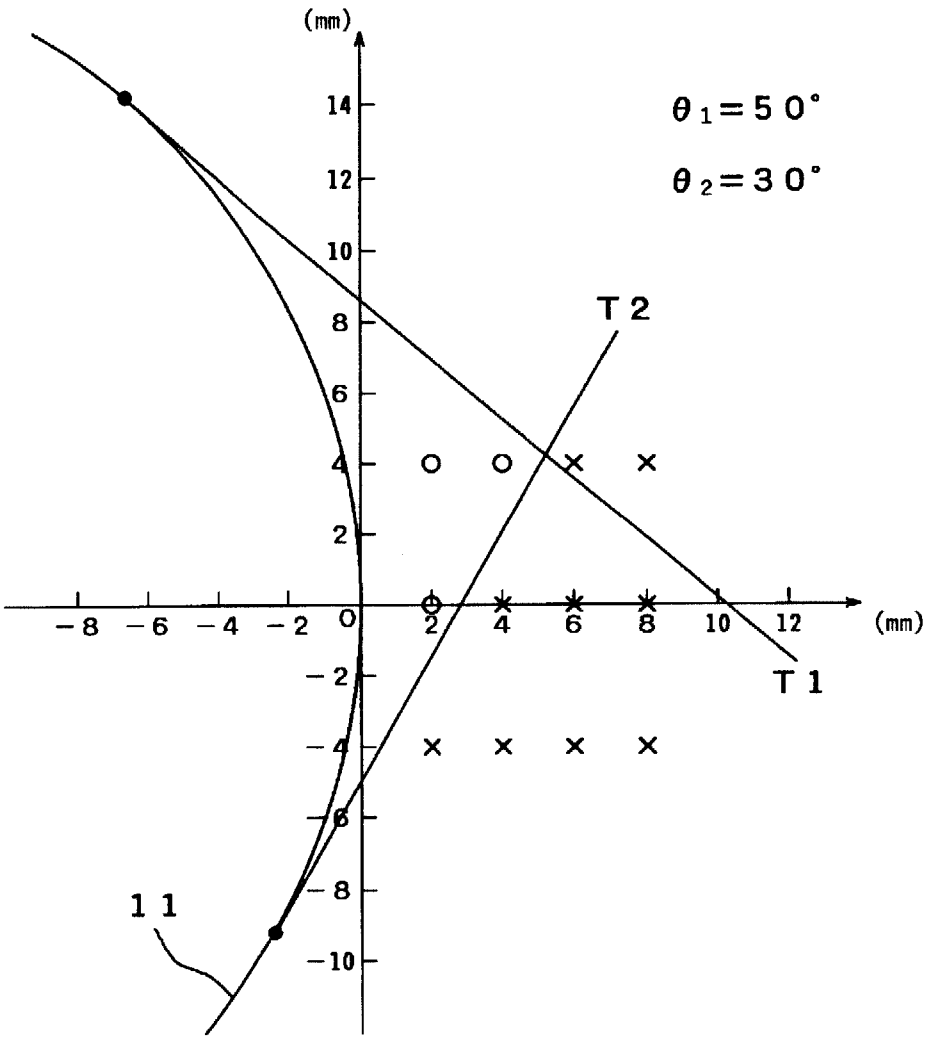
FIG. 8 is a diagram showing results obtained in performing development by using a developing sleeve having a diameter of 37 mm, respectively setting angles $\theta_1$ and $\theta_2$ between fixed magnetic poles N and the center line of the developing sleeve to 50° and 30°, and changing the position of the edge of a wall in the developing apparatus according to the embodiment 1.
Figure 9:
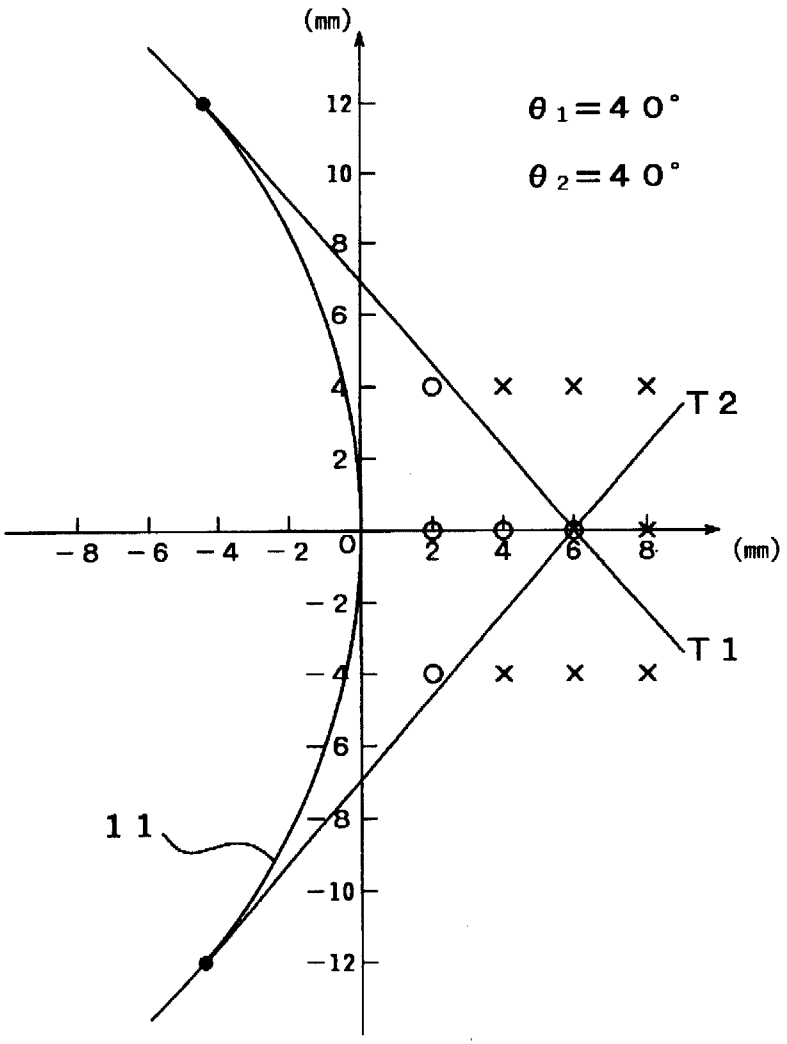
FIG. 9 is a diagram showing results obtained in performing development by using a developing sleeve having a diameter of 37 mm, respectively setting angles $\theta_1$ and $\theta_2$ between fixed magnetic poles N and the center line of the developing sleeve to 40° and 40°, and changing the position of the edge of a wall in the developing apparatus according to the embodiment 1.
Figure 10:
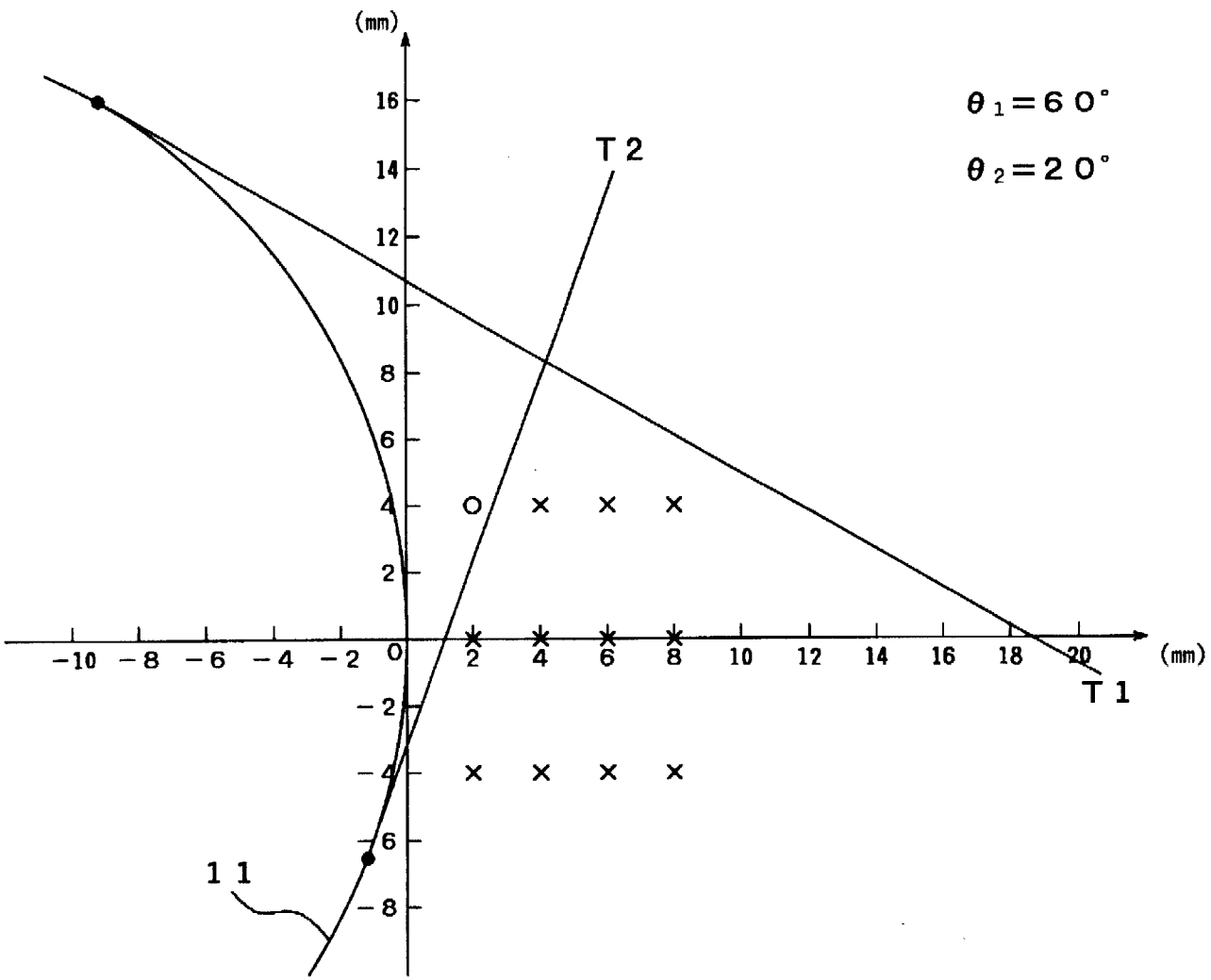
FIG. 10 is a diagram showing results obtained in performing development by using a developing sleeve having a diameter of 37 mm, respectively setting angles $\theta_1$ and $\theta_2$ between fixed magnetic poles N and the center line of the developing sleeve to 60° and 20°, and changing the position of the edge of a wall in the developing apparatus according to the embodiment 1.

In the developing apparatus using the developing sleeve 11 having a diameter of 18 mm, results obtained in respectively setting the angles $\theta_1$ and $\theta_2$ to 30° and 70° are shown in FIG. 5, results obtained in respectively setting the angles $\theta_1$ and $\theta_2$ to 40° and 60° are shown in FIG. 6, and results obtained in respectively setting the angles $\theta_1$ and $\theta_2$ to 50° and 50° are shown in FIG. 7. Further, in the developing apparatus using the developing sleeve 11 having a diameter of 37 mm, results obtained in respectively setting the angles $\theta_1$ and $\theta_2$ to 50° and 30° are shown in FIG. 8, results obtained in respectively setting the angles $\theta_1$ and $\theta_2$ to 40° and 40° are shown in FIG. 9, and results obtained in respectively setting the angles $\theta_1$ and $\theta_2$ to 60° and 20° are shown in FIG. 10.

As apparent from the results shown in FIGS. 5 to 10, in a case where the edge of the wall 14 is positioned in the area formed by the tangent lines T1 and T2 to the developing sleeve 11 at the points where the fixed magnetic poles N have the maximum vertical magnetic force and the peripheral surface of the developing sleeve 11, the developer returned to the apparatus body 10 after the development is reliably separated from the surface of the developing sleeve 11 before passing through the wall 14 as described above, and new developer is supplied to the developing sleeve 11 and used for development, whereby the difference in density in the formed image is small. On the contrary, when the edge of the wall 14 is positioned outside the area, the developer after the development is not satisfactorily separated from the surface of the developing sleeve 11, and the developer after the development is used for development again, whereby the difference in density in the formed image is large.

Figure 11:
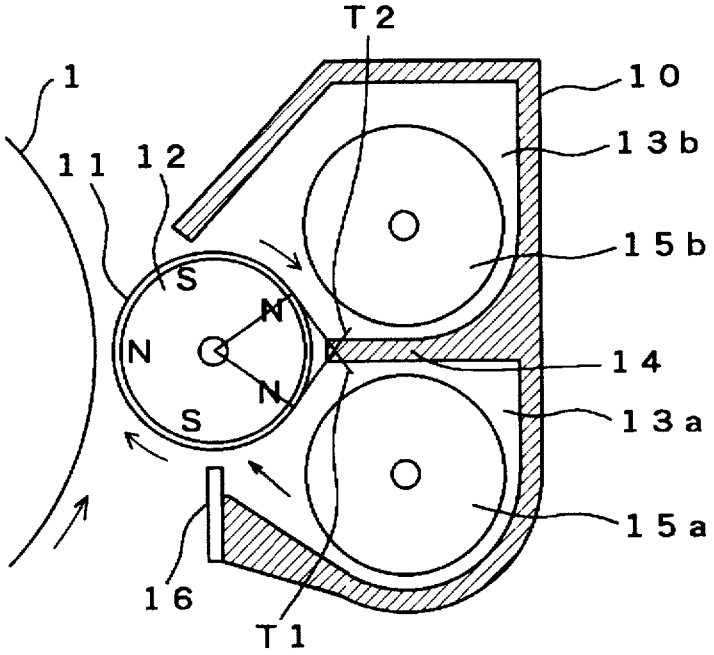
FIG. 11 is a schematic illustration showing the state of a modified example of the developing apparatus according to the embodiment 1.

Although in the developing apparatus according to the above-mentioned embodiment, the developer is supplied to the surface of the developing sleeve 11 from the developer supplying portion 13*a* positioned above the wall 14, while the developer returned to the apparatus body 10 after the development is collected in the developer collecting portion 13*b* positioned below the wall 14, it is also possible to rotate the developing sleeve 11 in the opposite direction, supply the developer to the surface of the developing sleeve 11 from the developer supplying portion 13*a* positioned below the wall 14, regulate the quantity of the developer by the regulating member 16, then introduce the developer into the image carrier 1 to perform development, then return the developer after the development remaining on the surface of the developing sleeve 11 to the apparatus body 10, and collect the developer after the development in the developer collecting portion 13*b* positioned above the wall 14, as shown in FIG. 11.

Also in the developing apparatus shown in FIG. 11, when the fixed magnetic poles N having the same polarity are so provided as to be adjacent to each other on the upstream and downstream sides in the direction of rotation of the developing sleeve 11 in such a manner that the wall 14 is interposed therebetween along the inner periphery of the developing sleeve 11 in a position opposite to the wall 14 as described above, and the edge of the wall 14 is positioned in the area formed by the tangent lines T1 and T2 to the developing sleeve 11 at the points where the fixed magnetic poles N have the maximum vertical magnetic force and the peripheral surface of the developing sleeve 11, the developer returned to the apparatus body 10 after the development is satisfactorily separated from the developing sleeve 11 before passing through the wall 14 and is collected in the developer collecting portion 13*b* positioned above the wall 14.

(Embodiment 2)

Figure 12:
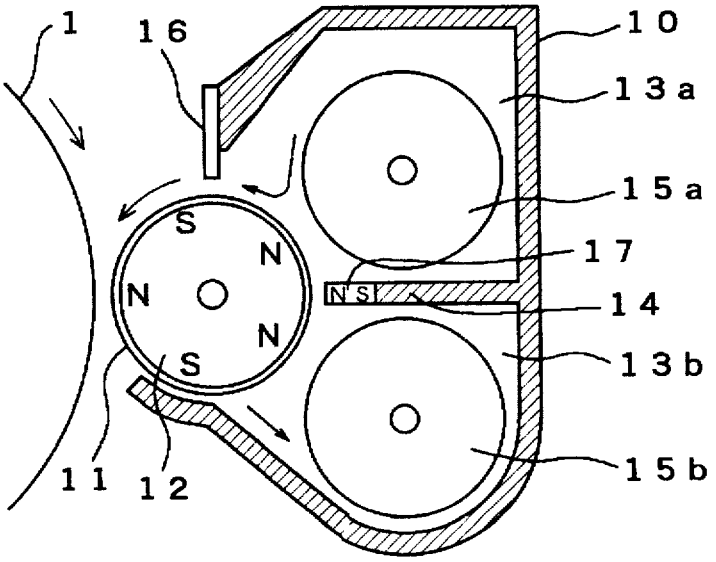
FIG. 12 is a schematic illustration showing the state of a developing apparatus according to an embodiment 2 of the present invention.

Also in a developing apparatus according to an embodiment 2, a magnet member 12 having a plurality of fixed magnetic poles N, S, . . . arranged along its periphery is provided along the inner periphery of a developing sleeve 11 in a cylindrical shape provided opposite to an image carrier 1, a developer supplying portion 13*a* and a developer collecting portion 13*b* are vertically aligned with a wall 14 interposed therebetween in an apparatus body 10 so as to be opposite to the developing sleeve 11 in its axial direction, the developer supplying portion 13*a* and the developer collecting portion 13*b* are respectively provided with feeding members 15*a* and 15*b*, developer is respectively conveyed in the developer supplying portion 13*a* and the developer collecting portion 13*b* by the feeding members 15*a* and 15*b*, and the developer is circulated between the developer supplying portion 13*a* and the developer collecting portion 13*b* as shown in FIG. 12, as in the developing apparatus according to the embodiment 1.

In the developing apparatus according to the embodiment 2, fixed magnetic poles N having the same polarity are so provided as to be adjacent to each other on the upstream and downstream sides in the direction of rotation of the developing sleeve 11 in such a manner that the wall is interposed therebetween along the inner periphery of the developing sleeve 11 in a position opposite to the edge of the wall 14, while a magnetic member 17 is provided at the edge of the wall 14 so that its N pole having the same polarity as that of the fixed magnetic poles N is opposite to the developing sleeve 11.

When the N pole of the magnetic member 17 is so provided as to be opposite to the developing sleeve 11 between the fixed magnetic poles N provided along the inner periphery of the developing sleeve 11, a repulsive magnetic field is generated between the N pole of the magnetic member 17 and each of the fixed magnetic poles N on the upstream and downstream sides in the direction of rotation of the developing sleeve 11. When the developer after the development is returned to the apparatus body 10 by the developing sleeve 11 to approach the magnetic member 17 provided at the edge of the wall 14, the developer on the surface of the developing sleeve 11 is reliably separated by the repulsive magnetic field.

As a result, also in the developing apparatus according to the embodiment 2, the developer returned to the apparatus body 11 after the development is satisfactorily separated from the surface of the developing sleeve 11 before passing through the wall 14 and is collected in the developer collecting portion 13*b*, new developer is supplied to the surface of the developing sleeve 11 from the developer supplying portion 13*a*, and the new developer is always conveyed to the image carrier 1 by the developing sleeve 11 and used for development, whereby a formed image is not decreased in density, is not made non-uniform in density, and is not fogged, for example, upon degradation of the developer, as in the developing apparatus according to the embodiment 1.

Figure 13:
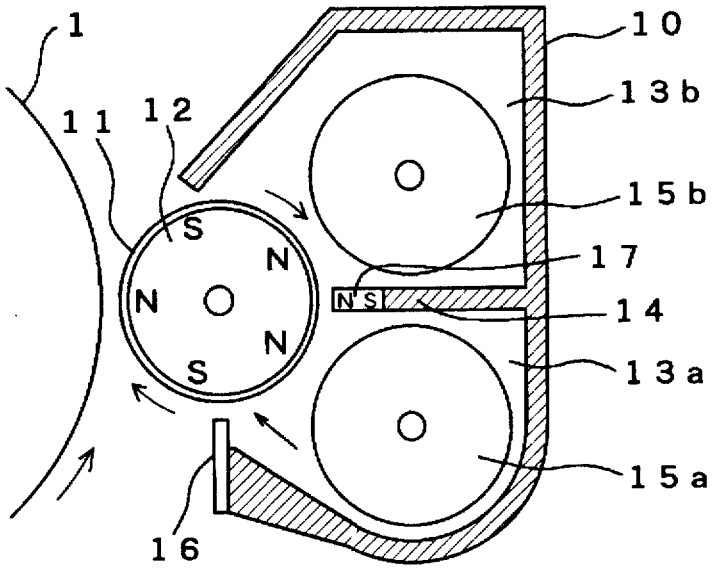
FIG. 13 is a schematic illustration showing a first modified example of the developing apparatus according to the embodiment 2.

Although in the developing apparatus according to the present embodiment shown in FIG. 12, the developer is supplied to the surface of the developing sleeve 11 from the developer supplying portion 13*a* positioned above the wall 14, while the developer returned to the apparatus body 10 after the development is collected in the developer collecting portion 13*b* positioned below the wall 14, it is also possible to rotate the developing sleeve 11 in the opposite direction, supply the developer to the surface of the rotating developing sleeve 11 from the developer supplying portion 13*a* positioned below the wall 14, regulate the quantity of the developer by the regulating member 16, then introduce the developer into the image carrier 1 to perform development, then return the developer after the development remaining on the surface of the developing sleeve 11 to the apparatus body 10, and collect the developer after the development in the developer collecting portion 13*b* positioned above the wall 14, as shown in FIG. 13.

Also in this case, when the N pole of the magnetic member 17 is so provided as to be opposite to the developing sleeve 11 between the fixed magnetic poles N provided along the inner periphery of the developing sleeve 11, the developer returned to the apparatus body 10 after the development is satisfactorily separated from the surface of the developing sleeve 11 before passing through the wall 14, and is collected in the developer collecting portion 13*b* positioned above the wall 14.

Figure 14:
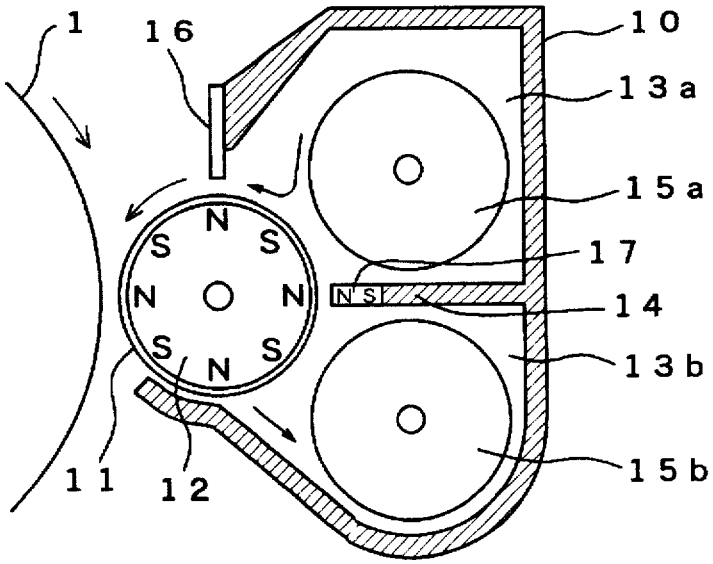
FIG. 14 is a schematic illustration showing a second modified example of the developing apparatus according to the embodiment 2.

Although in each of the developing apparatuses shown in FIGS. 12 and 13, the fixed magnetic poles N having the same polarity are provided on the upstream and downstream sides in the direction of rotation of the developing sleeve 11 in such a manner that the wall 14 is interposed therebetween along the inner periphery of the developing sleeve 11 in a position opposite to the wall 14, the fixed magnetic pole N having the same polarity as that of the N pole of the magnetic member 17 provided at the edge of the wall 14 can be also provided along the inner periphery of the developing sleeve 11 in a position opposite to the N pole of the magnetic member 17, as shown in FIG. 14.

Also in such a case, a repulsive magnetic field is exerted between the fixed magnetic pole N provided along the inner periphery of the developing sleeve 11 and the N pole of the magnetic member 17. When the developer after the development is returned to the apparatus body 10 by the developing sleeve 11 to approach the magnetic member 17 provided at the edge of the wall 14, the developer on the surface of the developing sleeve 11 is reliably separated by the repulsive magnetic field, whereby the same effect as that in the case of the above-mentioned developing apparatus is obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing apparatus comprising:

a rotating developing sleeve;

a developer supplying portion for supplying developer to the surface of the developing sleeve;

a developer collecting portion for collecting the developer from the surface of the developing sleeve, said developer supplying portion and said developer collecting portion being vertically aligned;

a pair of magnetic poles which are adjacent to each other and are fixed in the developing sleeve, said pair of magnetic poles forming a triangle area which is surrounded by tangent lines at points where the magnetic poles have the maximum magnetic force, said pair of magnetic poles have a same polarity;

an adjacent pole which is adjacent to the pair of magnetic poles and is positioned at the upstream side of the pair of magnetic poles with respect to the rotating direction of the developing sleeve, said adjacent poles has a polarity that is opposite the polarity of the pair of magnetic poles; and a wall positioned between the developer supplying portion and the developer collecting portion, the edge of the wall being positioned in the triangle area formed by the pair of magnetic poles.

2. The developing apparatus according to claim 1, wherein said pair of magnetic poles have the same polarity.

3. The developing apparatus according to claim 1, wherein the developer supplying portion is positioned above the developer collecting portion.

4. The developing apparatus according to claim 1, wherein the developer collecting portion is positioned above the developer supplying portion.

5. The developing apparatus according to claim 1, wherein the developer is circulated between the developer collecting portion and the developer supplying portion.

6. The developing apparatus according to claim 5, wherein rotating screws are respectively provided in the developer collecting portion and the developer supplying portion.

7. The developing apparatus according to claim 1, further comprising a regulating member for regulating the quantity of the developer supplied to the surface of the developing sleeve from said developer supplying portion.

8. A developing apparatus comprising:

a rotating developing sleeve having a plurality of fixed magnetic poles provided along its inner periphery, said fixed magnetic poles include a pair of magnetic poles which are adjacent to each other and have a same polarity;

a developer supplying portion for supplying developer to the surface of the developing sleeve;

a developer collecting portion for collecting the developer from the surface of the developing sleeve, said developer supplying portion and said developer collecting portion being vertically aligned; and a wall positioned between the developer supplying portion and the developer collecting portion, the edge of the wall having a magnetic force and a same polarity as the pair of magnetic poles, wherein said edge is opposite the pair of magnetic poles.

9. The developing apparatus according to claim 8, wherein the developer supplying portion is positioned above the developer collecting portion.

10. The developing apparatus according to claim 8, wherein the developer collecting portion is positioned above the developer supplying portion.

11. The developing apparatus according to claim 8, wherein the developer is circulated between the developer collecting portion and the developer supplying portion.

12. The developing apparatus according to claim 11, wherein rotating screws are respectively provided in the developer collecting portion and the developer supplying portion.

13. The developing apparatus according to claim 8, further comprising a regulating member for regulating the quantity of the developer supplied to the surface of the developing sleeve from said developer supplying portion.

14. An image forming apparatus comprising an image carrier; and a developing apparatus comprising a rotating developing sleeve, a developer supplying portion for supplying developer to the surface of the developing sleeve, a developer collecting portion for collecting the developer from the surface of the developing sleeve, said developer supplying portion and said developer collecting portion being vertically aligned, a pair of magnetic poles which are adjacent to each other and are fixed in the developing sleeve, said pair of magnetic poles forming a triangle area which is surrounded by tangent lines at points where the magnetic poles have the maximum magnetic force, said pair of magnetic poles have a same polarity;

an adjacent pole which is adjacent to the pair of magnetic poles and is positioned at an upstream side of the pair of magnetic poles with respect to the rotating direction of the developing sleeve. said adjacent poles has a polarity that is opposite the polarity of the pair of magnetic poles, and a wall positioned between the developer supplying portion and the developer collecting portion, the edge of the wall being positioned in the triangle area formed by the pair of magnetic poles.

15. An image forming apparatus comprising:

an image carrier; and a developing apparatus comprising:

a rotating developing sleeve having a plurality of fixed magnetic poles provided along its inner periphery, said fixed magnetic poles include a pair of magnetic poles which are adjacent to each other and have a same polarity, a developer supplying portion for supplying developer to the surface of the developing sleeve, a developer collecting portion for collecting the developer from the surface of the developing sleeve, said developer supplying portion and said developer collecting portion being vertically aligned, and a wall positioned between the developer supplying portion and the developer collecting portion, the edge of the wall having a magnetic force and a same polarity as the pair of magnetic poles, wherein said edge is opposite the pair of magnetic poles.

16. A developing apparatus comprising:

a rotating developing sleeve having a plurality of fixed magnetic poles provided along its inner periphery;

a developer supplying portion for supplying developer to the surface of the developing sleeve;

a developer collecting portion for collecting the developer from the surface of the developing sleeve, said developer supplying portion and said developer collecting portion being vertically aligned;

a wall positioned between the developer supplying portion and the developer collecting portion and separated from the developing sleeve by a gap, an end of the wall adjacent the rotating developing sleeve having a magnetic force; and one of the plurality of fixed magnetic poles is opposite the end of the wall;

a magnetic pole at the end of the wall and the opposite fixed magnetic pole have the same polarity;

a passageway interconnecting the developer supplying portion and the developer collecting portion defined by a pair of circulation ports to form a circulation of developer.

17. The developing apparatus of claim 20, wherein the passageway interconnecting the developer supplying portion and the developer collecting portion defined by the pair of circulation ports forms an axial circulation of developer.

* * * * *